US006367579B1

(12) United States Patent
Wiener

(10) Patent No.: US 6,367,579 B1
(45) Date of Patent: Apr. 9, 2002

(54) INFLATABLE SPEAKER ASSEMBLY

(75) Inventor: David Wiener, Park City, UT (US)

(73) Assignee: SoundTube Entertainment, Inc., Park City, UT (US)

( * ) Notice: Subject to any disclaimer, the term of this patent is extended or adjusted under 35 U.S.C. 154(b) by 0 days.

(21) Appl. No.: 09/494,983

(22) Filed: Jan. 31, 2000

(51) Int. Cl.[7] ..... A47B 81/06
(52) U.S. Cl. ..... 181/199; 181/156
(58) Field of Search ..... 181/141, 151, 181/155, 156, 166, 160, 199; 381/386, 395; 297/217.1, 217.4, 217.5

(56) References Cited

U.S. PATENT DOCUMENTS

| | | | | |
|---|---|---|---|---|
| 3,872,235 | A | 3/1975 | Manly, Jr. | |
| 4,109,983 | A | 8/1978 | Kinoshita | |
| 4,356,882 | A | 11/1982 | Allen | |
| 4,811,403 | A | 3/1989 | Henricksen et al. | |
| 4,823,907 | A | 4/1989 | Hoshi | |
| 4,991,222 | A * | 2/1991 | Nixdorf | 381/386 |
| 5,046,104 | A | 9/1991 | Kloss | |
| 6,135,551 | A * | 10/2000 | Linder | 297/217.4 |

* cited by examiner

*Primary Examiner*—Khanh Dang
(74) *Attorney, Agent, or Firm*—David P. Gordon; David S. Jacobson; Thomas A Gallagher

(57) ABSTRACT

A speaker assembly is provided including a rigid front speaker mounting element defining at least one speaker mounting opening, at least one speaker driver coupled to the at least one speaker mounting opening of the speaker mounting element, at least one flexible bladder at least partially forming the sides and rear of the enclosure and coupled to the speaker mounting element, and a valve coupled to the flexible bladder. The flexible bladder has a first wall portion and a second wall portion defining a substantially air-tight interior space therebetween and may take any desired shape when inflated. Together, the speaker mounting element and the bladder form at least one interior chamber at least partially surrounding the speaker driver. The valve, which provides a substantially air-tight seal when closed, is in fluid communication with the interior space of the flexible bladder and can be used for inflation and deflation of the bladder. The bladder is inflatable by providing either pressurized gas or expandable foam within the interior space. Alternately, the bladder may be formed as a plurality of independently inflatable cells, or may be evacuatably-formed from a material having shape retaining memory properties. After use, the bladder enclosure may be removed from the speaker mounting element, and deflated for reuse, or disposed of.

35 Claims, 8 Drawing Sheets

INFLATABLE SPEAKER ASSEMBLY

BACKGROUND OF THE INVENTION

1. Field of the Invention

This invention relates broadly to stereo speakers. More particularly, this invention relates to lightweight, portable stereo speakers.

2. State of the Art

Sound quality is important in the design of sound reproducing systems, such as speakers used in concert halls, home stereo systems, and portable stereo systems. Further, size, shape, weight, and portability are also important. The size and shape and ultimate weight of the entire stereo system is often driven by the speaker sound quality requirements. Sound quality and other acoustical resonance related characteristics are enhanced by having an enclosed air volume behind the speaker driver. In general, the optimal size of the enclosure will depend on the size of the speaker driver. Generally, for space and weight constrained sound systems including boomboxes and portable stereos, the smaller speaker drivers are mounted within a relatively small housing or enclosure which provides less than ideal quality sound reproduction. To improve the sound quality, using a larger driver, and hence enclosure is preferable. For large high-fidelity speaker drivers i.e., those used for public address, concert, or stadium sound systems, optimal quality sound reproduction requires using relatively large high-fidelity speaker drivers and mounting them within relatively large enclosures. Toward this end, large high fidelity speaker drivers are generally mounted within large rectangular substantially hollow boxes formed from wood, pressed board, or hard plastic. Although such enclosures are quite sturdy, they are generally heavy, bulky, and cumbersome. Further, they often require great strength and effort to move and install, and require sturdy supports to mount on speaker stands. When used in touring events, these large speaker systems can require numerous trucks to transport them from event to event. When not in use, they require a large storage facility. Collapsible speaker enclosures have been designed which alleviate some of the bulkiness and difficulties related to storage and transport of these large speaker assemblies. However, the weight of the collapsible speaker assemblies remain the same whether in the extended or collapsed state.

SUMMARY OF THE INVENTION

It is therefore an object of the invention to provide a portable speaker assembly which is lightweight, portable, and easily mountable and which has good sound quality.

It is another object of the invention to provide a portable speaker assembly which requires minimal freight or storage volume yet which has a desirable air chamber volume behind the speaker.

It is a further object of the invention to provide a portable speaker assembly having an expandable bladder which expands to form a desired shape and size substantially forming the exterior of the speaker enclosure.

It is an additional object of the invention to provide a portable speaker assembly having a vacuum deflatable bladder formed from a material having a memory for an expanded shape once the vacuum is removed.

It is yet another object of the invention to provide a portable speaker assembly which has fire retarding properties.

In accord with these objects, which will be discussed in detail below, a speaker assembly includes a rigid front speaker mounting element, at least one speaker driver coupled to the speaker mounting element, a flexible bladder coupled to the speaker mounting element, and a valve coupled to the flexible bladder. The bladder preferably is formed having a first wall portion and a second wall portion defining a substantially air-tight interior space therebetween. The bladder is preferably formed from a flexible, puncture resistant or healable material which can withstand repeated cycles of inflation and deflation and which may be formed to take any desired shape when inflated. Together, the rigid front speaker mounting element and the flexible bladder form an enclosure defining at least one interior chamber at least partially surrounding the speaker driver. The valve, which provides a substantially air-tight seal when closed, is in fluid communication with the interior space of the flexible bladder and is used for inflation and deflation of the bladder.

According to one embodiment of the invention, the flexible bladder is inflatable by providing either pressurized gas or expandable foam within the interior space of the inflatable flexible bladder. Additionally, a fire retarding powder or fire retarding gas may also be introduced within the flexible bladder. According to additional embodiments of the invention, the inflatable speaker enclosure assembly may include preferred aspects such as a sound port for improved low frequency sound transmission, internal or external tension straps to prevent over-inflation, internal structural support ribs for cross-bracing, and multiple bladders for structural strength. Further, the flexible bladder may be formed as a multi-celled bladder which prevents deflation of the entire speaker enclosure in the event one cell is damaged. Additional embodiments may include a rigid rear member coupled to the inflatable bladder opposite the rigid front speaker mounting element which may be ported thereby providing an opening between the interior chamber and an exterior environment.

According to another embodiment, the speaker enclosure assembly may further include a hard-shell substantially enclosing the flexible bladder. The housing is designed to resemble a typical hard-shelled speaker enclosure case and may be designed to break down into flat boards. When inflated, the flexible bladder is disposed substantially along an internal perimeter of the shell.

According to yet another embodiment, the flexible bladder is deflatable by providing a vacuum to evacuate any gas contained within the interior space of the flexible bladder. Until released from vacuum, the bladder maintains its evacuated state. The bladder is preferably formed from a material having a memory for the expanded shape such that once released from vacuum, the bladder reassumes a desired expanded shape and size. Alternatively, the bladder may instead contain memory expanding material such as expandable open-celled foam or polyester batting.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
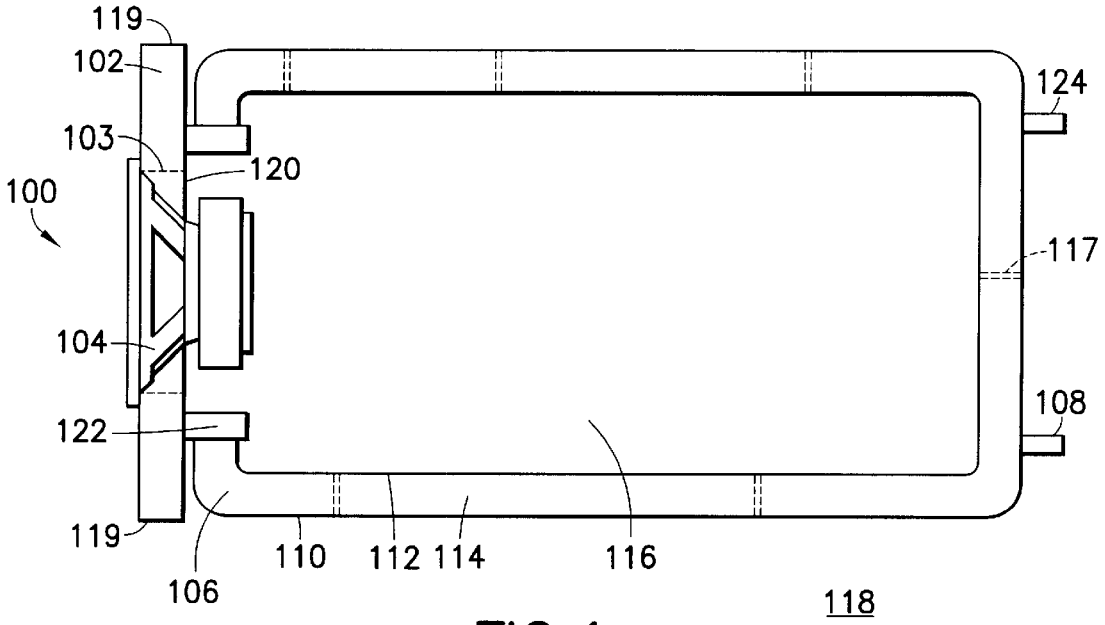
FIG. 1 is a [sectional] schematic view of a first embodiment of a speaker assembly having an inflatable flexible bladder designed according to the invention.

Turning now to FIG. 1, a first embodiment of a speaker assembly 100 includes a rigid front speaker mounting element 102 defining a speaker mounting opening 103, at least one speaker driver 104 coupled to the speaker mounting opening 103 of the speaker mounting element 102, an inflatable flexible bladder 106 coupled to the speaker mounting element 102, and a valve 108 in fluid communication with the bladder 106. The bladder 106 has a first wall portion 110 and a second wall portion 112 defining a substantially air-tight interior space 114 therebetween. Together, the speaker mounting element 102 and the bladder 106 form an enclosure defining an interior chamber 116 at least partially surrounding the speaker driver 104. The interior chamber 116 is separated from an exterior environment 118. The valve 108, which provides a substantially air-tight seal for the bladder 106 when closed, is in fluid communication with the interior space 114 of the bladder 106. The valve 108 provides a port for inflation and deflation of the flexible bladder 106.

According to the first embodiment 100, the speaker mounting element 102 has ends 119 and a rear face 120 preferably having a lip 122 projecting therefrom. The bladder 106, which is preferably formed from a PVC or other synthetic, flexible, durable material, or from a laminate of synthetic or natural materials is inflatable to a desired size and shape (e.g. a cylinder, frustum, or a parallelpiped) by providing either pressurized gas or expandable foam within the interior space 114 of the bladder 106. The bladder 106 is preferably detachably coupled to the lip 122 via hook and loop tape, straps, brackets, clips, clamps, adhesives, friction fit coupling (inside or outside), flanges with screws, threaded or bayonet male/female couplings, or otherwise, such that the bladder 106 can be removed and replaced if damaged, no longer required, or to gain access to the rear of the speaker driver 104. The bladder 106 may further include at least one additional valve 124, also in fluid communication with the interior space 114 of the flexible bladder 106 which is adapted to provide for a rapid release of the pressurized gas from within the interior space 114 when deflating the bladder 106. Additionally, the first wall portion 110 and the second wall portion 112 of the inflatable bladder 106 are optionally connected or joined from within the interior space 114 with one or more spacers 117 attached to both wall portions such that the two wall portions 110, 112 substantially maintain a desired spacing. The spacer 117 is preferably a small piece or web of a flexible yet sturdy material such as nylon attached to each wall portion 110, 112 by a strong, yet flexible adhesive, (stitching, or otherwise. Alternately, the spacer 117 may be formed integrally with the two wall portions 110, 112 of the bladder 106.

Figure 2:
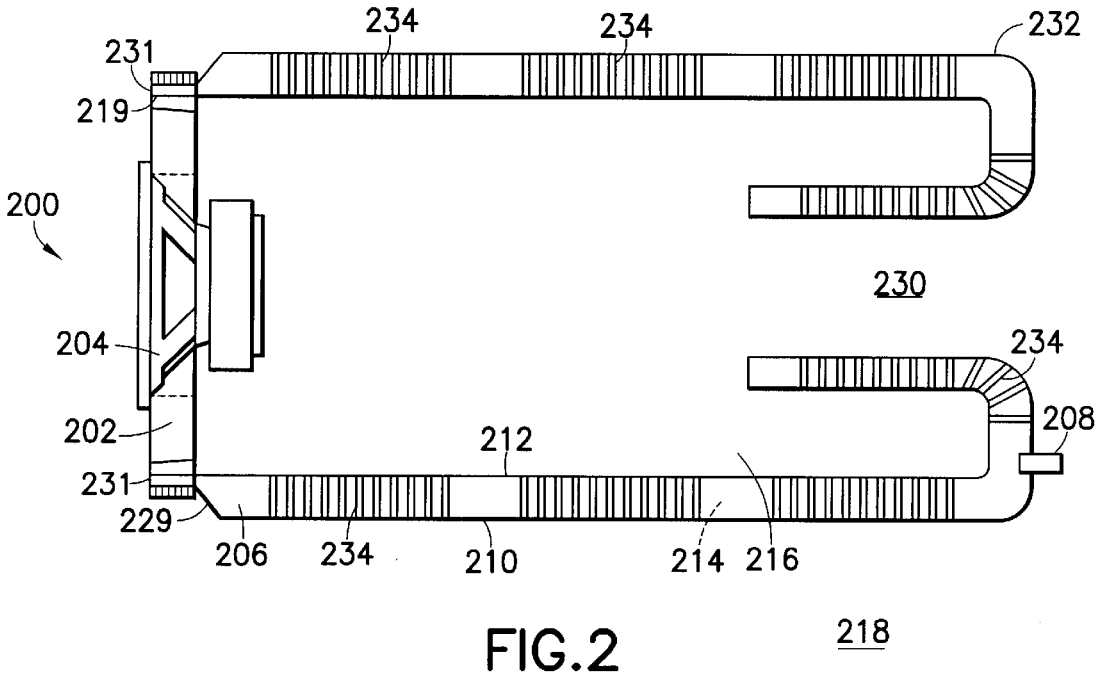
FIG. 2 is a [sectional] schematic view of a second embodiment of the speaker assembly having tension straps disposed between the walls of the inflatable flexible bladder.

Turning now to FIG. 2, a second embodiment of a speaker assembly 200, substantially similar to the first embodiment 100 with like parts numbered similarly incremented by 100, is shown. In the second embodiment, the flexible bladder 206 of the speaker assembly 200 has a mounting end 229 which tapers down to form a tab 231 which is used for securing the bladder 206 to the speaker mounting element 202. More particularly, the tab 231 of the bladder 206 attaches to the ends 219 of the speaker mounting element 202. The bladder 206 is preferably detachably coupled to the ends 219 of the speaker mounting element 202 via hook and loop tape, straps, brackets, clips, clamps, adhesives, friction fit coupling (inside or outside), or otherwise such that the bladder 206 can be removed and replaced if damaged, no longer required, or to gain access to the rear of the speaker driver 204. In addition, the bladder 206 has a rear portion 232 defining a sound port 230 which provides a portal between the interior chamber 216 and the exterior environment 218 for rearward dispersion of sound and enhanced low frequency response. Further, instead of spacers, the speaker assembly 200 includes a plurality of tension straps 234 preferably disposed on or about at least a portion of both the first wall portion 210 and the second wall portion 212 within the interior space 214. The tension straps 234 are preferably formed from a flexible yet sturdy material e.g. nylon, and prevent both over-inflation of the inflatable bladder 206 and help maintain the shape of the speaker assembly 200 while inflated.

Figure 3A:
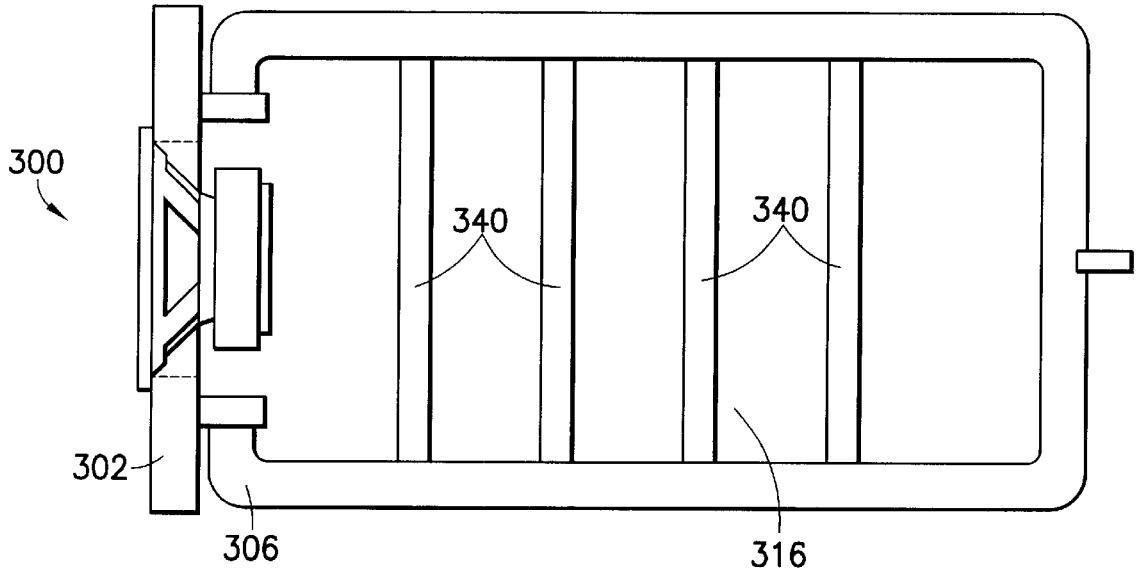
FIG. 3*a* is a [sectional] schematic view of a third embodiment of the speaker assembly having the inflatable flexible bladder in which the bladder is provided with internal structural ribs.
Figure 3B:
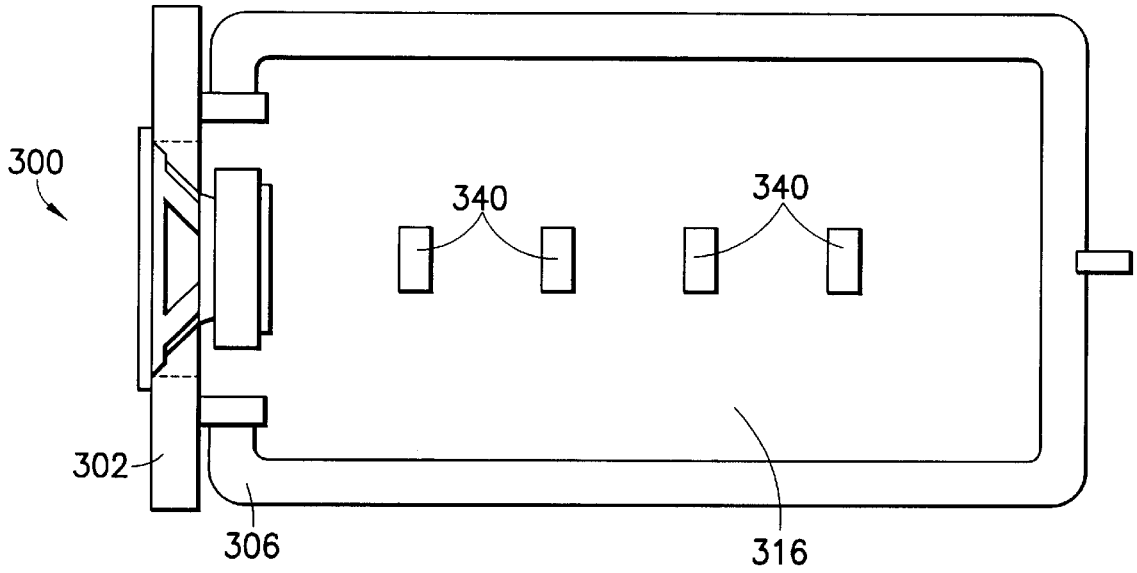
FIG. 3*b* is a [sectional] schematic view of the third embodiment of the speaker assembly taken perpendicular to the structural view of FIG. 3*a;*

A third embodiment of a speaker assembly 300, substantially similar to the first embodiment 100 with like parts numbered similarly incremented by 200, is shown in FIGS. 3*a* and 3*b*. The speaker assembly 300 further includes a plurality of spaced structural ribs or cross-bracing members 340 which are adapted to provide structural stability to the bladder 306 of the inflatable speaker assembly 300 and help maintain the desired shape of the speaker assembly 300 while the bladder 306 is inflated while not undesirably affecting the resonant characteristics within the interior chamber 316. While shown as being solid, the ribs 340 may be inflatable and in fluid communication with the bladder 306. The bladder 306 is attached to the speaker mounting element 302 in any desired manner.

Figure 4:
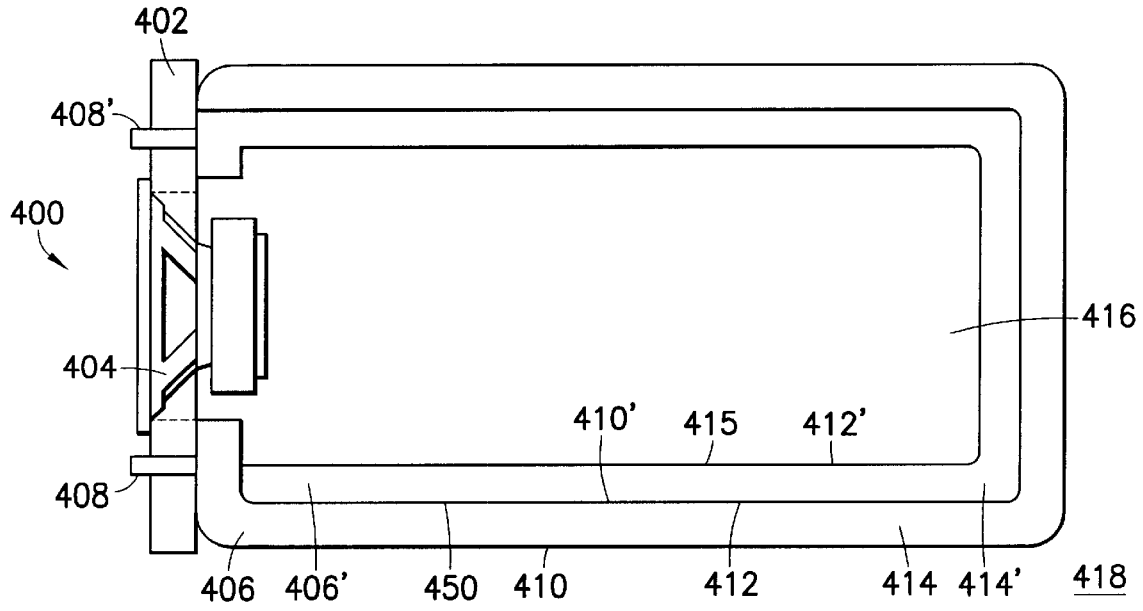
FIG. 4 is a [sectional] schematic view of a fourth embodiment of the speaker assembly having a plurality of inflatable flexible bladders.

Turning now to FIG. 4, a fourth embodiment of a speaker assembly 400, substantially similar to the first embodiment 100 with like parts numbered similarly incremented by 300, is shown. In the fourth embodiment, the speaker assembly 400 includes a second flexible bladder 406' coupled to the speaker mounting element 402, and a second valve 408' coupled to the second flexible bladder 406'. As in the first embodiment 100, both the first and second flexible bladders 406, 406' have a first wall portion 410, 410' and a second wall portion 412, 412' each pair defining a substantially air-tight interior space 414, 414' therebetween. When inflated, the second bladder 406' increases structural rigidity of the speaker assembly 400 and helps maintain the integrity of the speaker assembly 400 in the event the first bladder 406 is compromised. As shown, the first and second bladders 406, 406' share a common wall 450 further increasing structural rigidity and enhancing the acoustical resonance characteristics of the speaker assembly 400. Preferably, each of the bladders 406, 406' may be independently inflated and deflated through valves 408 and 408' which extend through openings in the mounting element 402. Together, the speaker mounting element 402 and the bladders 406, 406' form an enclosure 415 defining an interior chamber 416 at least partially surrounding the speaker driver 404 and at least partially separating the interior chamber 416 from an exterior environment 418. The bladders 406 and 406' are coupled to the mounting element 402 in any desirable manner.

Figure 5A:
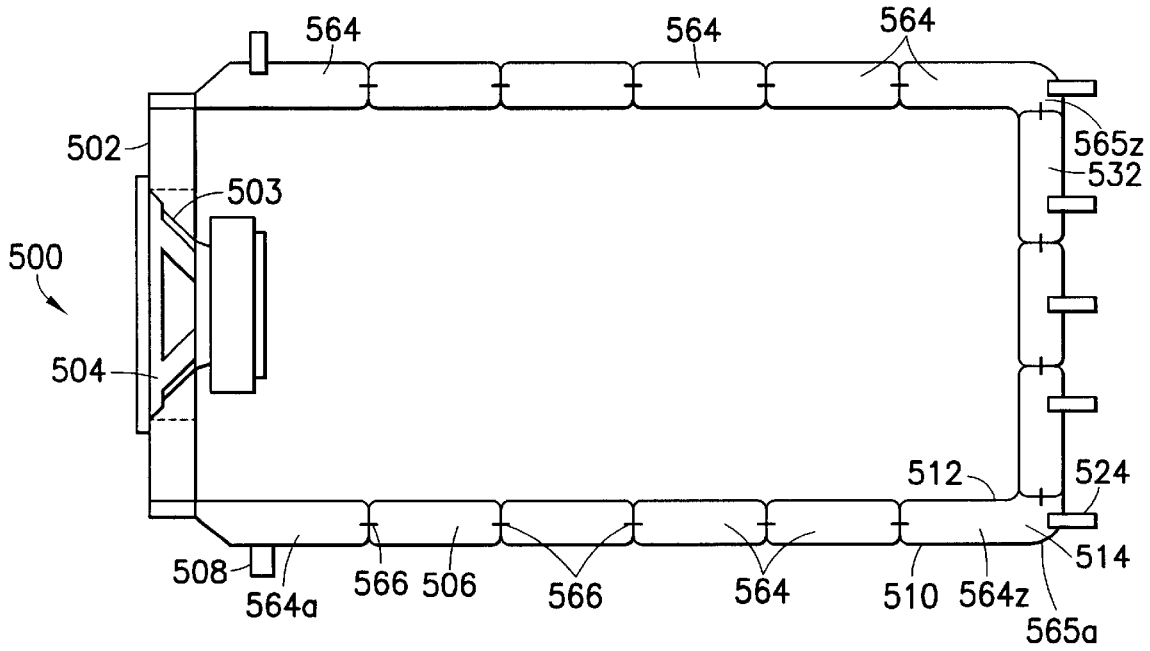
FIG. 5*a* is a [sectional] schematic view of a fifth embodiment of the speaker assembly having an inflatable multi-celled flexible bladder.
Figure 5B:
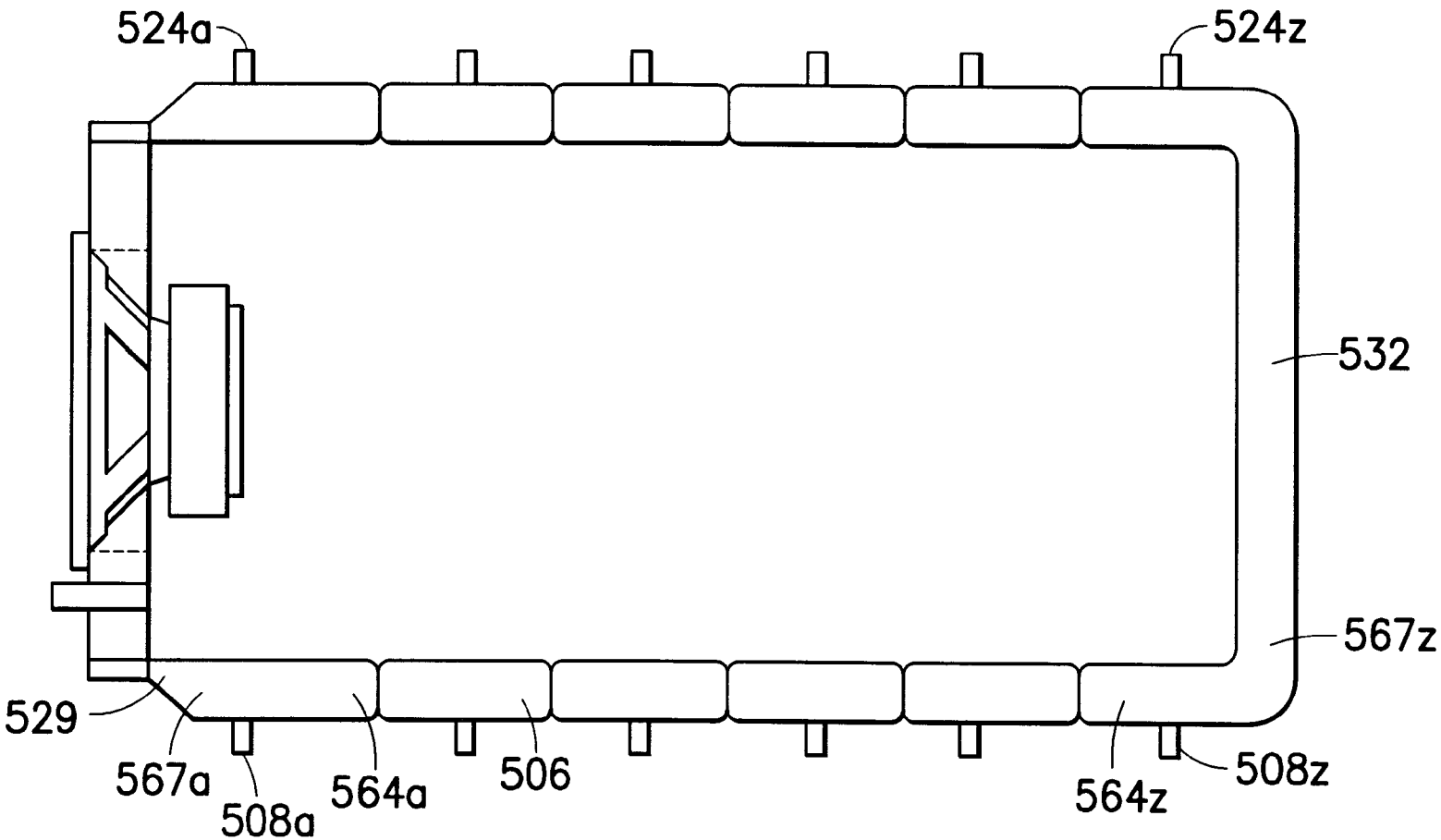
FIG. 5*b* is a [sectional] schematic view of an alternative fifth embodiment of the speaker assembly having an inflatable multi-celled flexible bladder.

A fifth embodiment of a speaker assembly 500, substantially similar to the first embodiment 100 with like parts numbered similarly incremented by 400, is shown in FIG. 5*a*. The speaker assembly 500 includes a rigid front speaker mounting element 502 defining a speaker mounting opening 503, a speaker driver 504 coupled to the speaker mounting opening 503, an inflatable flexible bladder 506 having a front portion 529 and a rear portion 532 preferably detachably coupled to the speaker mounting element 502, and a valve 508 for inflation/deflation preferably coupled to the bladder 506 near the front portion 529. As shown, the bladder 506 is formed as a plurality of independently inflatable cells 564. Similar to the first embodiment of the speaker assembly 100, each of the plurality of cells 564 forming the flexible bladder 506 has a first wall portion 510 and a second wall portion 512 defining a substantially air-tight interior space 514 therebetween. Further, each of the individual cells 564 forms a substantially air-tight seal between neighboring cells 564. The plurality of cells 564 may be arranged in a plurality of rows 565*a*–565*z* formed as a plurality of individual cells 564*a*–564*z* with each row having an inflation valve 508*a*–508*z* at one end and a deflation valve 524*a*–524*z* at an opposing end and each cell within the row being connected by a pressure sensitive one-way valve 566. The cells 564 are each fluidly connected to an adjoining cell 564 through a series of pressure sensitive one-way valves 566. The one-way valves 566 direct flow from the inflation valve 508 at a cell 564*a* at the front portion 529 of the bladder 506 toward the cells 564*z* in the rear portion 532 of the bladder 506 when a pressurized gas is supplied through the valve 508. A deflation port 524 is provided for applying a negative pressure for deflation purposes. The valves 566 increase control of inflation of the bladder 506 and provides a means of protecting the speaker assembly 500 against complete deflation should one cell 564 be compromised. If desired, rather than providing one-way valves 566 between cells in a row, each individual cell 564 may be provided with its own inlet valve for individual inflation of the cells 564. According to an alternate fifth embodiment shown in FIG. 5*b*, the plurality of cells 564 of the inflatable bladder 506 may instead be arranged as a plurality of inflatable rings 567*a*–567*z* connected from the front portion 529 of the inflatable bladder 506 to the rear portion 532 with each ring 567*a*–567*z* having its own inflation valve 508*a*–508*z* and its own deflation valve 524*a*–524*z*.

Figure 6:
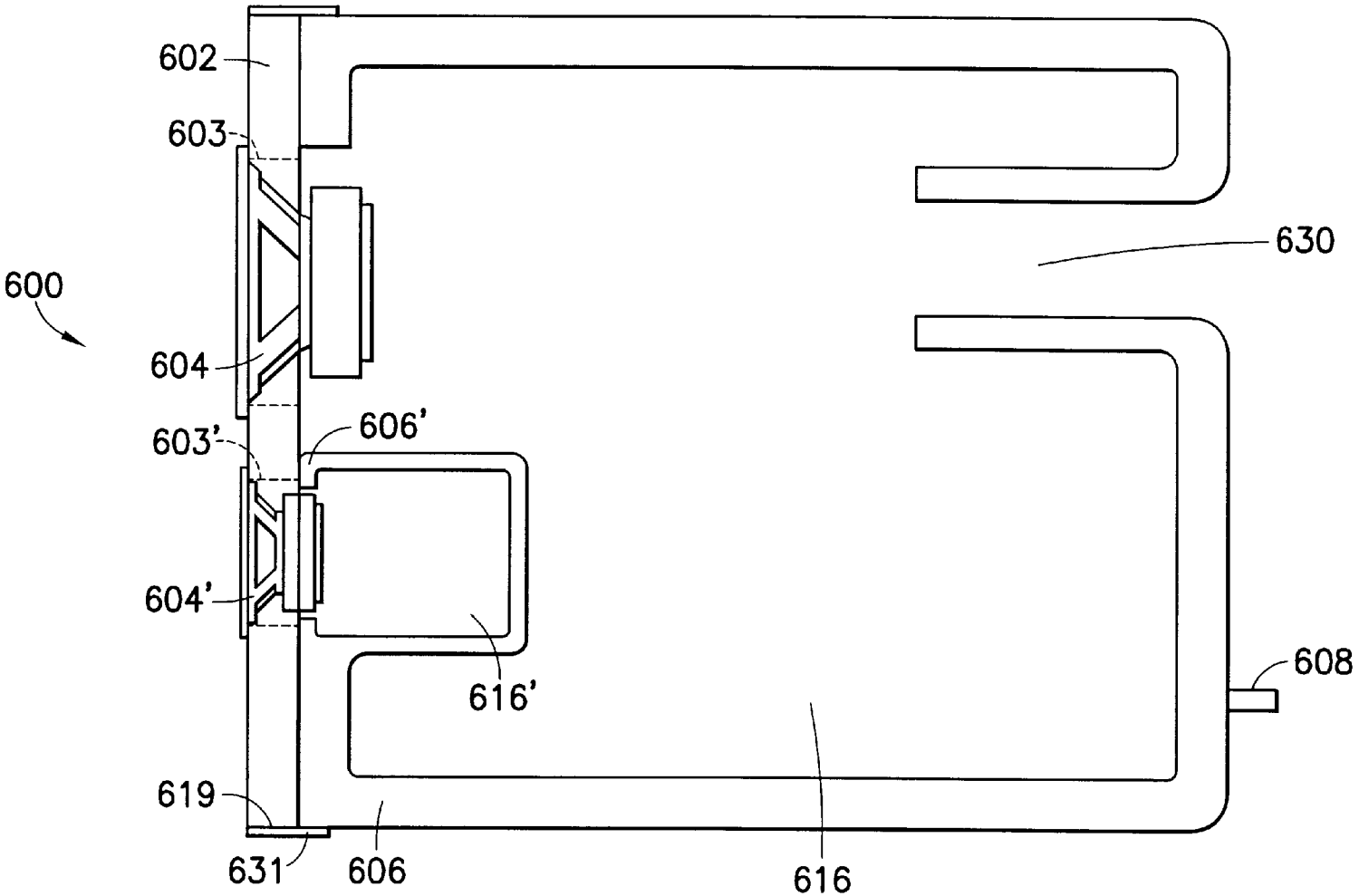
FIG. 6 is a [sectional] schematic view of a sixth embodiment of the speaker assembly having an inflatable flexible bladder which forms multiple air chamber each partially surrounding a speaker driver.

Turning now to FIG. 6, a sixth embodiment of a speaker assembly 600, substantially similar to the first embodiment 100 with like parts numbered similarly incremented by 500, is shown. The speaker assembly 600 includes a rigid front speaker mounting element 602 defining a first speaker mounting opening 603 and a second speaker mounting opening 603', a first speaker driver 604 and a second speaker driver 604' each coupled to one of the first or second speaker mounting openings 603, 603' of the speaker mounting element 602, an inflatable flexible bladder 606 coupled to the speaker mounting element 602 and forming a sound port 630, and a valve 608 coupled to the bladder 606. As shown, the bladder 606 is adapted to at least partially form an enclosure defining two interior chambers, a first interior chamber 616 which at least partially surrounds the first speaker driver 604 and a second interior chamber 616' which at least partially surrounds the second speaker driver 604'. The first interior chamber 616 is within and substantially separated from the second interior chamber 616'. The dual chamber arrangement results in distinct and independent acoustical properties affecting the sound produced by each of the speaker drivers 604, 604'. As shown in FIG. 6, the bladder 606 is coupled to the outer edge 619 of the speaker mounting element 602 by a flap, tab, or ring of material 631 which may be clamped or otherwise attached thereto. Optionally, ports (not shown) may be provided in the speaker mounting element 602 adjacent the second speaker driver 604' so that the portion of the bladder 606' adjacent the speaker driver may be pulled into engagement with the speaker mounting element 602. Otherwise, a VELCRO®-type fastener could be utilized with the bladder portion 606' being attached to the back of the speaker mounting element prior to inflation.

Figure 7:
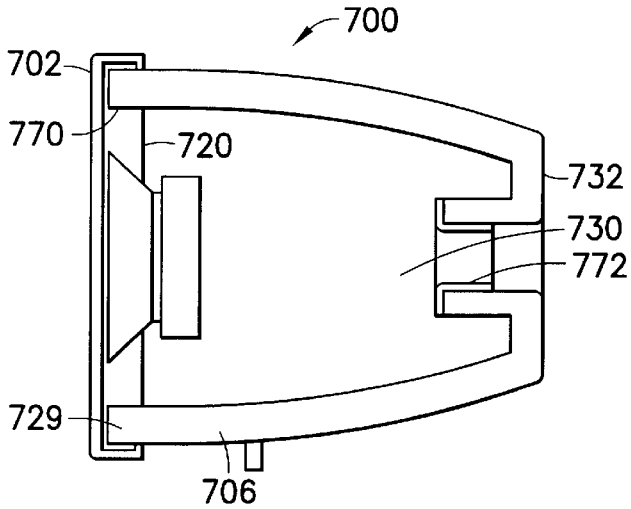
FIG. 7 is a [sectional] schematic view of a seventh embodiment of the speaker assembly having a rigid insert maintaining the sound port opening in the inflatable bladder.
Figure 8:
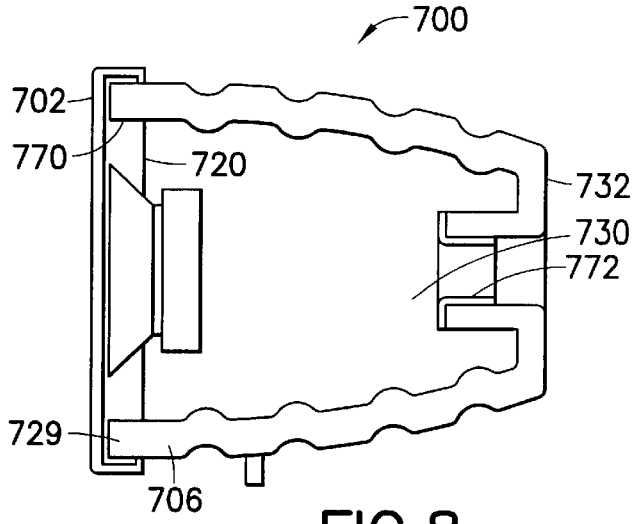
FIG. 8 is a [sectional] schematic view of a seventh embodiment of the speaker assembly having an inflatable flexible bladder formed into a desirable undulating shape when inflated.

Turning now to FIGS. 7 and 8, a seventh embodiment of a speaker assembly 700, substantially similar to the first embodiments 100 with like parts numbered similarly incremented by 600, is shown. Instead of forming a lip on the rear face 720 of the speaker mounting element 702, the rear face 720 of the rigid front speaker mounting element 702 defines a channel 770 into which the front portion 729 of the bladder 706 of the speaker assembly 700 is coupled to the speaker mounting element 702 when inflated (e.g. by VELCRO® or a friction fit). Further, the speaker assembly 700 includes a rigid insert 772 adapted to fit within a sound port 730 formed in the rear portion 732 of the bladder 706. The rigid insert 772 maintains the desired size and shape of the sound port 730 and provides support to a rear portion 732 of the flexible bladder 706. As shown specifically in FIG. 8, the inflatable flexible bladder 706 can be formed to expand such that it takes any desired shape when inflated, such as the undulating shape shown. Further, it will be appreciated that the inflatable flexible bladder 706 can be formed such that it expands to any desirable size when inflated.

Figure 9:
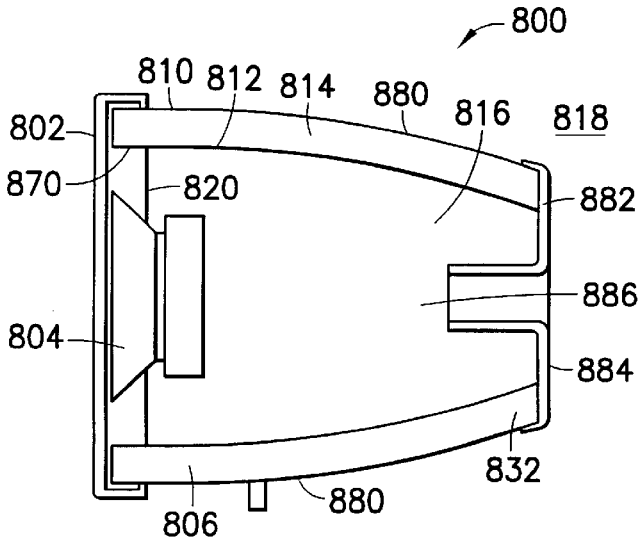
FIG. 9 is a [sectional] schematic c view of an eighth embodiment of the speaker assembly including a rigid rear member.

An eighth embodiment 800 of a speaker assembly 800, substantially similar to the first embodiment 100 with like parts numbered similarly incremented by 700, is shown in FIG. 9. The bladder 806 of the speaker assembly 800 substantially forms only a side wall or walls 880 of the speaker assembly 800 and a rigid rear member 882 substantially forms a rear 884 of the speaker assembly 800. The rigid rear member 882 attaches to the rear portion 832 of the bladder 806. As with the seventh embodiment of the speaker assembly 700, the bladder 806 is also coupled to the speaker mounting element 802 within the channel 870. Together, the speaker mounting element 802, the bladder 806, and the rear member 882 substantially form an enclosure defining an interior chamber 816 at least partially surrounding the speaker driver 804 and separating the interior chamber 816 from an external environment 818 surrounding the speaker assembly 800. The rear member 882 may further define a sound port 886 which provides a portal between the interior chamber 816 and the exterior environment 818 for rearward dispersion of sound.

Figure 10:
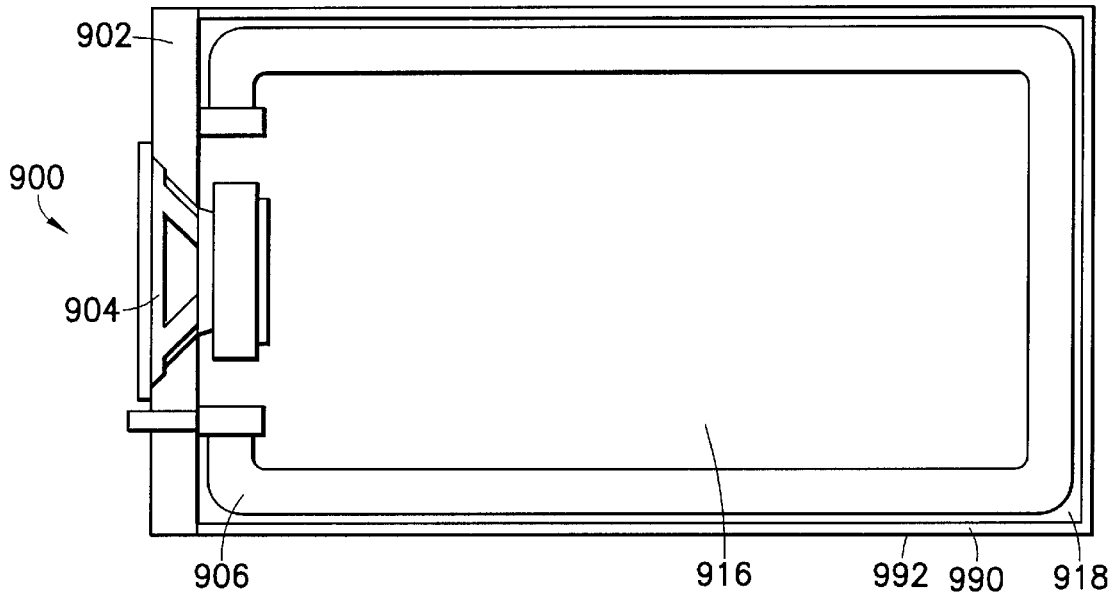
FIG. 10 is a [sectional] schematic view of a ninth embodiment of the speaker assembly having an inflatable flexible bladder substantially disposed about the interior perimeter of a thin walled, hard-shell speaker housing.

A ninth embodiment of a speaker assembly 900, substantially similar to the first embodiment 100 with like parts numbered similarly incremented by 800, is shown in FIG. 10. The speaker assembly 900 includes a speaker mounting element 902, a speaker driver 904, and an inflatable flexible bladder 906. As with speaker assembly 100, together, the speaker mounting element 902 and the bladder 906 substantially form an enclosure defining an interior chamber 916 at least partially surrounding the speaker driver 904. The interior chamber 916 is separated from an exterior environment 918. In addition, the speaker assembly 900 includes a lightweight, thin walled, hard-shell housing 990, which is preferably comprised of multiple panels which may be hinged or otherwise connected so that the shell may be knocked down to flat sheets and transported or stored. The housing 990 is preferably formed from wood, a wood product, plastic, or other lightweight yet durable material which may be coupled if desired to the rigid front speaker mounting element 902, substantially enclosing the flexible bladder 906. The housing 990 is designed to resemble a typical hard-shell speaker assembly case and functions to protect the inflatable flexible bladder 906 from inadvertent penetration by a foreign object (not shown). When inflated, the bladder 906 expands to substantially conform to the shape of the housing 990 and is substantially disposed along an internal perimeter 994 of the housing 990.

Figure 11:
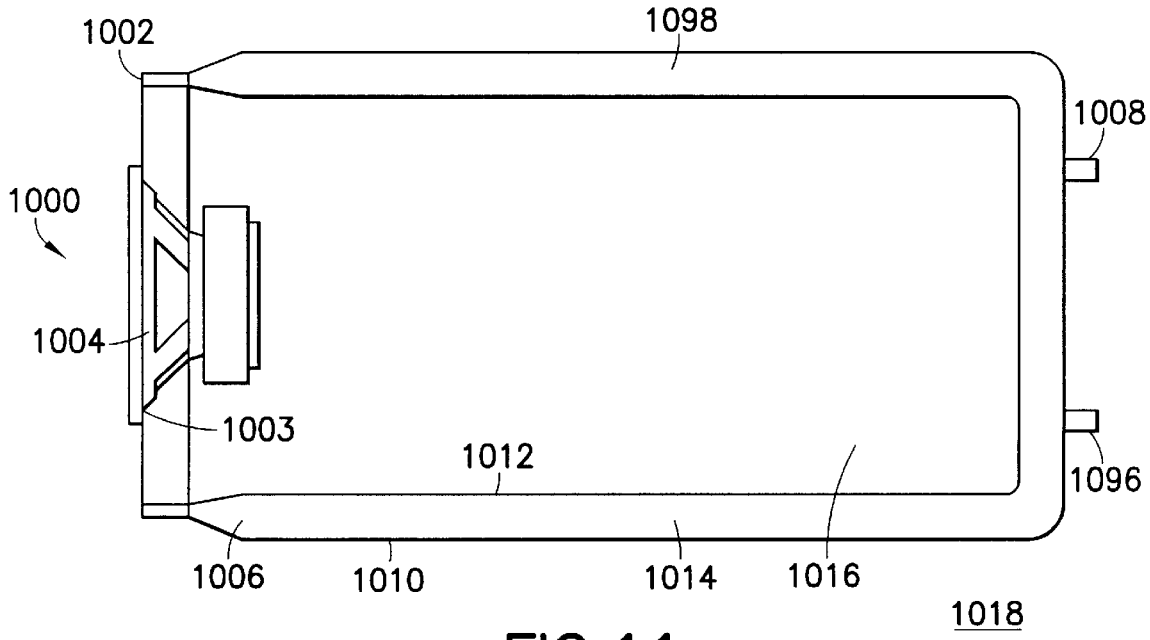
FIG. 11 is a [sectional] schematic view of an tenth embodiment of the speaker assembly having an evacuatable flexible bladder according to the invention.

Turning now to FIG. 11, a tenth embodiment of a speaker assembly 1000, substantially similar to the first embodiment 100 with like parts numbered similarly incremented by 900, is shown. The speaker assembly 1000 includes a rigid front speaker mounting element 1002 defining a speaker mounting opening 1003, a speaker driver 1004 coupled to the speaker mounting opening 1103 of the speaker mounting element 1002, a vacuum evacuatable flexible bladder 1006 coupled to the speaker mounting element 1002, and an evacuation valve 1008 coupled to the bladder 1006. The flexible bladder 1006 has a first wall portion 1010 and a second wall portion 1012 defining an interior space 1014 therebetween. Together, the speaker mounting element 1002 and the bladder 1006 substantially form an enclosure defining an interior chamber 1016 at least partially surrounding the speaker driver 1004. The interior chamber 1016 is separated from an exterior environment 1018. Further, the bladder 1006 may be provided with at least one quick inflate valve 1096 coupled to the bladder 1006. Both the quick inflate valve 1096 and the evacuation valve 1008 are sealable and in fluid communication with the interior space 1014 of the bladder 1006. The bladder 1106 is preferably evacuated by providing a vacuum through the valve 1008 to evacuate any gas contained within the interior space 1014 of the flexible bladder 1006. Until released from vacuum, the bladder 1006 preferably maintains its evacuated state. The vacuum evacuatable bladder 1006 of the speaker assembly 1000 is preferably formed from a material having a memory for an expanded shape such that the bladder 1006 tends to take an expanded shape when released from vacuum. Preferably, the material is preformed or molded PVC, rubber, or composite with or without preformed foam filler. Alternately, instead of the bladder 1006 being formed from a memory expanding material, the bladder 1006 may instead contain memory expanding material 1098 such as expandable open-celled foam or polyester batting, which tends to force the bladder 1006 to take an expanded shape when released from vacuum. At least one quick inflate valve 1096 is preferably coupled to the bladder 1006 and in fluid communication with the interior space 1014 to quickly release the evacuated bladder 1006 from vacuum. As with the previous embodiments, the evacuatable bladder 1006 may be designed to expand to any desired size and to take any desired shape.

Figure 12A:
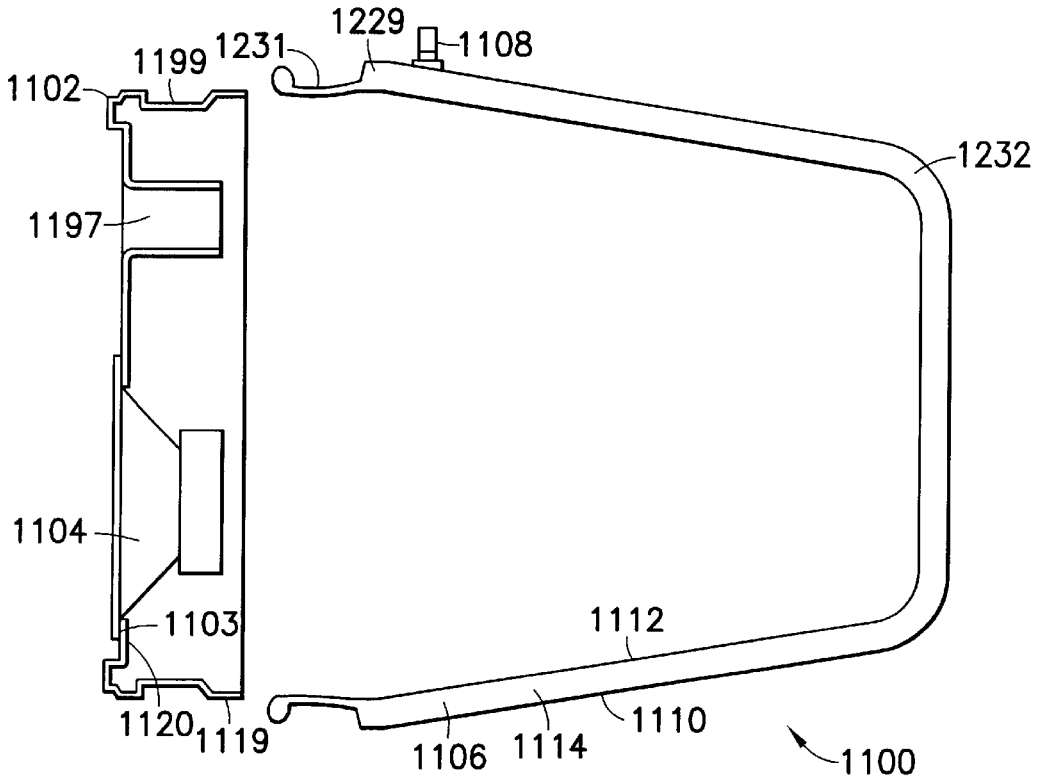
FIG. 12*a* is an exploded [sectional] schematic view of a eleventh embodiment of the speaker assembly having an inflatable flexible bladder.
Figure 12B:
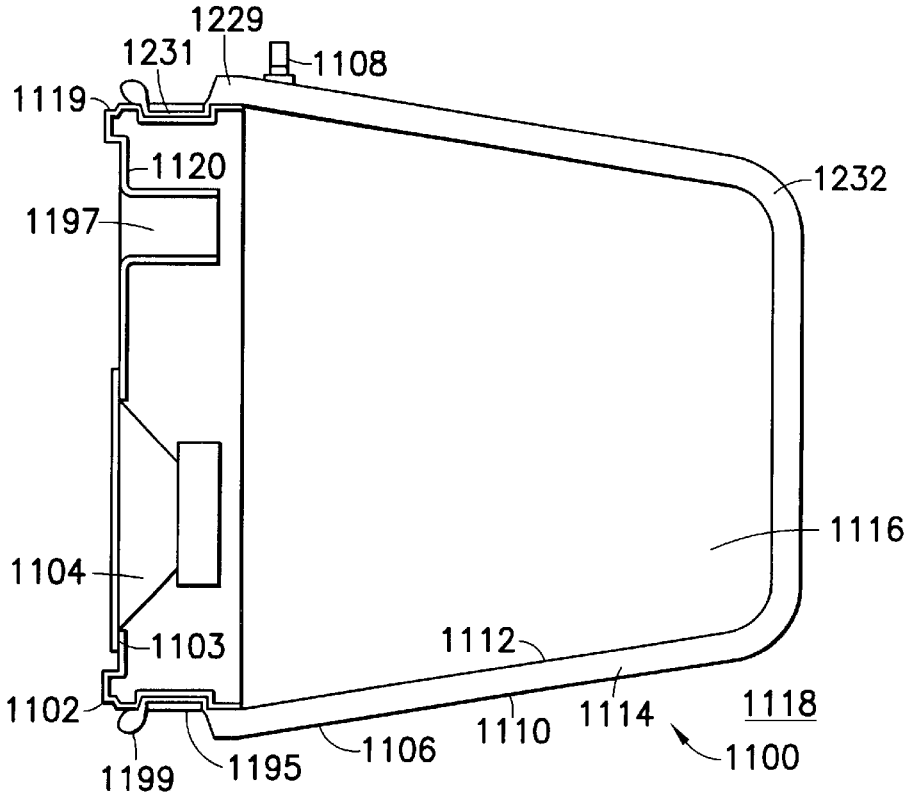
FIG. 12*b* is a [sectional] schematic view of the eleventh embodiment of the speaker assembly having an inflatable flexible bladder.

An eleventh embodiment of a speaker assembly 1100, substantially similar to the first embodiment 100 with like parts numbered similarly incremented by 1000, is shown in FIGS. 12*a* and 12*b*. The speaker assembly 1100 includes a rigid front speaker mounting element 1102 having a rear face 1120, at least one speaker driver 1104, an inflatable flexible bladder 1106 couplable to the speaker mounting element 1102, and a valve 1108 in fluid communication with the bladder 1106. The speaker mounting element 1102 defines a speaker mounting opening 1103 and a sound port 1197. Further, the speaker mounting element 1102 has a circumferential wall 1119 extending beyond the rear face 1120 which defines a recess or groove 1199. The bladder 1106 has a first wall portion 1110 and a second wall portion 1112 defining a substantially air-tight interior space 1114 therebetween. The bladder 1106 also has a front portion 1229 and a rear portion 1232. The front portion 1229 has a tab 1231 adapted to be secured within the recess 1199 of the speaker mounting element 1102. More particularly, the bladder 1106 is preferably detachably coupled to the speaker mounting element 1102 by engaging the tab 1231 of the bladder to the speaker mounting- element 1102 within the recess 1199 of the ends 1119 and securing it within the recess with a securing strap 1195. If desired, the bladder 1106 may instead be detachably coupled via hook and loop tape, brackets, clips, clamps, adhesives, friction fit coupling (inside or outside) or otherwise such that the bladder 1106 can be removed and replaced if damaged, no longer required, or to gain access to the rear of the speaker driver 1104. The valve 1108, which provides a port for inflation and deflation of the flexible bladder 1106, is in fluid communication with the interior space 1114 of the bladder 1106 and provides a substantially air-tight seal when closed. Together, the speaker mounting element 1102 and the bladder 1106 form an enclosure defining an interior chamber 1116 at least partially surrounding the speaker driver 1104. The interior chamber 1116 is separated from an exterior environment 1118.

There have been described and illustrated herein several embodiments of a portable speaker enclosure assembly. While particular embodiments of the invention have been described, it is not intended that the invention be limited thereto, as it is intended that the invention be as broad in scope as the art will allow and that the specification be read likewise. Thus, while embodiments having a specific number of speaker drivers, inflation/deflation valves, flexible bladders, and interior chambers, it will be appreciated that a speaker assembly may be formed having a plurality of speaker drivers, inflation/deflation valves, flexible bladders, and interior chambers. While a speaker driver formed as a cone and a magnet was disclosed, it will be appreciated that other types of electroacoustic transducers may also be used. Further, while embodiments having a specific number of quick purge valves, quick inflate valves, and sound ports were disclosed, it will be appreciated that a speaker assembly may be formed having fewer or more of any of these. In addition, while embodiments disclosed quick inflate/deflate valves, quick purge valves, and quick inflate valves in specific locations on the flexible bladder, it will be appreciated that a speaker assembly may be formed with any number of these positioned in other locations on the bladder as well. Also, while the speaker mounting element was disclosed as being rigid, it will be appreciated that the speaker mounting element need not be rigid. Likewise, while the rear member was disclosed as being rigid, it will be appreciated that the rear member need not be rigid. Further, while the speaker mounting element is disclosed mounted in the front of the speaker assembly, it will be appreciated that the speaker mounting element may be mounted in other parts of the speaker assembly including but not limited to the top, side, or back. Furthermore, while a speaker assembly having a single sound port was disclosed, it will be understood that speaker assemblies could be designed defining multiple sound ports or no sound ports. Further yet, it is understood that the sound port defined by the bladder may instead be defined by the side of the bladder. Still further, it will be appreciated that a sound port may also be provided in other parts of the speaker assembly. Also, while it is preferable to have tension straps attaching to both the first and second wall portions of the bladder, it will be appreciated that inflatable speaker enclosures could be designed having no tension straps or tension straps disposed upon only one wall portion of the bladder. Further, while tension straps formed from nylon were disclosed, it will be appreciated that the tension straps could be formed from other materials as well including but not limited to PVC, synthetic fabric, and rubber. Further, while an embodiment having two bladders sharing a common wall was disclosed, it is understood that there may be more than two bladders and adjoining bladders need not share a common wall. Also, while a particular material has been disclosed to form the inflatable bladder, it will be appreciated that other soft, flexible puncture resistant or self-healing materials may be used as well; for example and not by way of limitation, any combination of soft flexible fabric or plastic including flexible PVC, polyethylene, polyurethane, Kevlar composites, and rubbers. Also, while the evacuatable bladder was disclosed formed from a particular memory material, it is understood that the evacuatable bladder may be formed from other materials including but not limited to rubber, urethane, etc. In addition, while particular types of expandable memory materials have been disclosed to be included within the interior space of the evacuatable bladder, it will be understood that other s;elf-expandable memory materials can be used; for example, and not by way of limitation, PVC, rubber, urethane, composites, etc. Also, while a flexible bladder forming a separate internal chamber for each speaker driver is preferred, it will be recognized that an inflatable speaker assembly could be designed having fewer internal chambers than speaker drivers. Further, where the speaker mounting element is disclosed having ends, it will be appreciated that the ends actually form an exterior perimeter of the speaker mounting element. Additionally, while particular attachment devices and means were described for attaching the bladder to the speaker mounting element, it will be appreciated that other attachment means may be used as well. While an inflatable bladder has been disclosed which is inflatable by pressurized air, it is understood that other pressurized gases can be similarly used including a fire retarding or a fire extinguishing gas. Additionally, it will be appreciated that the interior space of the inflatable bladder may also be provided with a fire-retarding or fire extinguishing powder. Further yet, the interior space of the inflatable bladder may be filled with foams or other filling materials. If desired, the foams or other filling materials may take a "hard set" such that the bladder becomes rigid or semi-rigid, and such that after use, the bladder would be detached and discarded. Where such a hard-set foam or other material is utilized, it is preferable that the utilized material be recyclable, biodegradable, or even edible. While particular shaped embodiments of the bladder have been disclosed, it should further be understood that the bladder may be designed to expand to any desired size and to take any desired shape. Further, while it has been disclosed that the bladder is coupled to the speaker mounting element, it will be appreciated that the bladder is preferably detachably coupled to the speaker mounting element. Moreover, while particular configurations have been disclosed in reference to the shape of the speaker enclosure assembly it will be appreciated that other shapes and configurations could be used as well. Further, while particular uses for the speaker assemblies have been disclosed, it will be appreciated that it may be adapted for other uses as well, such as (by way of example and not by way of limitation) for portable computers, radios, and automobiles. Further, it will be appreciated that if fire retarding or extinguishing powder or gas is provided within the bladder, the inflatable speaker assembly may be mounted within ceilings and walls without the need for installing a metal fire box. It will therefore be appreciated by those skilled in the art that yet other modifications could be made to the provided invention without deviating from its spirit and scope as claimed.

What is claimed is:

1. A speaker assembly, comprising:

a) a substantially rigid speaker mounting element defining at least one speaker mounting opening;

b) at least one speaker driver coupled to said speaker mounting element so that sound from said speaker driver is projected through said at least one opening;

c) at least one flexible inflatable bladder having a first wall portion and a second wall portion, said first wall portion and said second wall portion defining a substantially air-tight first interior space therebetween;

d) means for coupling said inflatable bladder to said speaker mounting element such that said speaker mounting element and said at least one inflatable bladder substantially form a speaker enclosure substantially defining a first interior acoustic chamber of said enclosure at least partially surrounding said at least one speaker driver and which also receives said sound waves from said at least one speaker driver, said first interior acoustic chamber not in communication with said interior space of said bladder; and e) an inflation valve coupled to said at least one inflatable bladder and in fluid communication with said interior space of said at least one inflatable bladder, said inflation valve being sealable to form a substantially air-tight seal.

2. A speaker assembly according to claim 1, further comprising:

e) a pressurized gas provided into said first interior space such that said bladder is inflated.

3. A speaker assembly according to claim 2, wherein:
said pressurized gas is fire retarding gas.

4. A speaker assembly according to claim 1, further comprising:
e) an expandable foam provided into said first interior space such that said bladder is inflated.

5. A speaker assembly according to claim 1, wherein:
said at least one bladder defines a sound port between an exterior of said speaker assembly and said first interior chamber.

6. A speaker assembly according to claim 1, wherein:
said at least one inflatable bladder is detachably coupled to said speaker mounting element.

7. A speaker assembly according to claim 1, wherein:
said speaker mounting element defines at least two speaker mounting openings, said at least one speaker driver is at least two speaker drivers, said at least two speaker drivers being coupled to said at least two speaker mounting openings of said speaker mounting element.

8. A speaker assembly according to claim 7 wherein:
said speaker mounting element and said at least one inflatable bladder define a second interior chamber of said speaker assembly, said second interior chamber at least partially surrounding at least one of said at least two speaker drivers.

9. A speaker assembly according to claim 8, wherein:
said second interior chamber is defined entirely within said first interior chamber.

10. A speaker assembly according to claim 1, further comprising:
e) at least one purge valve coupled to said at least one inflatable bladder and in communication with said interior space of said at least one inflatable bladder, said purge valve being sealable to form a substantially air-tight seal.

11. A speaker assembly according to claim 1, wherein:
said at least one inflatable bladder is at least two inflatable bladders, each of said at least two inflatable bladders defining respective substantially air-tight interior spaces.

12. A speaker assembly according to claim 11, wherein:
said at least two inflatable bladders share a common wall.

13. A speaker assembly according to claim 11, wherein:
each of said at least two inflatable bladders has an inflation valve and a purge valve in communication with said respective interior spaces.

14. A speaker assembly according to claim 1, further comprising:
e) a substantially rigid member coupled to said at least one inflatable bladder substantially opposite said speaker mounting element, said member defining an opening between said exterior of said speaker assembly and said interior chamber of said speaker assembly.

15. A speaker assembly according to claim 1, wherein:
said inflatable bladder is formed from at least one of a puncture resistant material, a self-healing material, and a fire-resistant material.

16. A speaker assembly according to claim 1, wherein:
said inflatable bladder has a front end which tapers to form a flattened tab, said tab being coupled to said speaker mounting element.

17. A speaker assembly according to claim 16, further comprising:
e) a strap detachably securing said tab to said speaker mounting element.

18. A speaker assembly according to claim 1, further comprising:
e) at least one strap disposed along at least one of said first and said second wall portions, said at least one strap formed from a material having a greater tensile strength than a material of said bladder.

19. A speaker assembly according to claim 1, further comprising:
a plurality of ribs disposed substantially parallel to said speaker mounting element within said interior chamber.

20. A speaker assembly according to claim 1, wherein:
said inflatable bladder is formed as a plurality of inflatable cells, each cell being substantially sealed from an adjoining cell.

21. A speaker assembly according to claim 20, wherein:
each cell of said plurality of inflatable cells is separated by a one-way valve, each cell being in fluid communication with said inflation port through said one-way valves.

22. A speaker assembly, comprising:
a) a substantially rigid speaker mounting element defining at least one speaker mounting opening;
b) at least one speaker driver coupled to said speaker mounting element so that sound waves from said speaker driver is projected through said at least one opening;
c) at least one flexible substantially evacuated bladder having a first wall forming at least part of an exterior of said speaker assembly and a second wall forming at least part of an interior of said speaker assembly, said first wall and said second wall defining a substantially air-tight first interior space therebetween, said first evacuated bladder being coupled to said speaker mounting element such that said speaker mounting element and said at least one evacuated bladder define an interior acoustic chamber of said enclosure at least partially surrounding said at least one speaker driver and which also receives said sound waves from said speaker driver, said first interior space and said acoustic chamber not in communication with each other; and
d) a valve coupled to said evacuated bladder and in communication with said interior space of said at least one evacuated bladder, said valve being sealable to form a substantially air-tight seal.

23. A speaker assembly according to claim 22, wherein:
said at least one evacuated bladder is formed from a material which has a memory for a desired speaker assembly shape.

24. A speaker assembly according to claim 22, further comprising:
e) an open-celled compressible material disposed within said interior space of said at least one evacuatable bladder, said material having a memory for a non-compressed shape when released from vacuum.

25. A speaker assembly according to claim 22, further comprising:
e) at least one inflation valve coupled to said at least one evacuated bladder and in fluid communication with said interior space of said at least one evacuated bladder, said inflation valve being sealable to form a substantially air-tight seal.

26. A speaker assembly according to claim 22, wherein:
said at least one bladder defines a sound port between an exterior of said speaker assembly and said first interior chamber.

27. A speaker assembly according to claim 22, further comprising:

e) a substantially rigid member coupled to said at least one evacuated bladder substantially opposite said speaker mounting element, said member defining an opening between said exterior of said speaker assembly and said interior chamber of said speaker assembly.

28. A speaker assembly, comprising:

a) a speaker mounting element defining at least one speaker mounting opening;

b) at least one speaker driver coupled to said speaker mounting element so that sound from said speaker driver is projected through said at least one opening;

c) a substantially rigid exterior housing coupled to said speaker mounting element and at least partially surrounding at least a portion of said at least one speaker driver, said exterior housing having an interior perimeter;

d) at least one flexible inflatable bladder having a first wall portion extending along said perimeter of said exterior housing when inflated and a second wall portion forming at least part of an interior of said speaker enclosure, said first wall portion and said second wall portion defining a substantially air-tight interior space therebetween, said at least one flexible inflatable bladder being coupled to said speaker mounting element such that said speaker mounting element and said at least one flexible inflatable bladder define a first interior chamber of said enclosure within said interior of said enclosure at least partially surrounding said at least one speaker driver; and e) an inflation valve coupled to said at least one inflatable bladder and in communication with said interior space of said at least one flexible inflatable bladder, said inflation valve being sealable to form a substantially air-tight seal.

29. In a speaker assembly including a speaker mounting element defining a speaker mounting opening, a speaker driver coupled to the speaker mounting element so that sound from the speaker driver is projected through the opening, and an enclosure at least partially defining an acoustic chamber behind the speaker driver, wherein the improvement comprises:

a) that said enclosure is an inflatable bladder having a first wall portion and a second wall portion, said first wall portion and said second wall portion defining a substantially air-tight first interior space therebetween which is not in communication with said acoustic chamber; and b) an inflation valve coupled to said inflatable bladder and in fluid communication with said interior space of said inflatable bladder, said inflation valve being sealable to form a substantially air-tight seal.

30. A method, comprising:

a) arranging a substantially rigid front speaker mounting element defining a speaker mounting opening with a speaker driver situated to direct sound waves through said opening;

b) obtaining a flexible inflatable bladder defining an interior space; and c) making a speaker enclosure by inflating said inflatable bladder such that said inflatable bladder at least partially constitutes the sides and rear of the enclosure, and said front speaker mounting element defines a front of said enclosure when said flexible inflatable bladder is coupled to said front speaker mounting element, said enclosure enclosing an acoustic chamber separate and distinct from said interior space which is in fluid communication with a rear of said speaker driver.

31. A method according to claim 30, wherein:

said making a speaker enclosure includes coupling said inflatable bladder to said front speaker mounting element in a substantially air-tight relationship.

32. A method according to claim 30, wherein:

said inflating comprises forcing gas into said inflatable bladder.

33. A method according to claim 30, wherein:

said inflating comprises forcing foam into said inflatable bladder.

34. A method according to claim 30, further comprising:

d) utilizing said speaker driver to make music with said inflatable bladder inflated; and e) deflating said inflatable bladder for reuse.

35. A method according to claim 30, further comprising:

d) utilizing said speaker driver to make music with said inflatable bladder inflated; and e) removing and discarding said inflatable bladder.

* * * * *